US012516496B2

(12) United States Patent
Noda et al.

(10) Patent No.: US 12,516,496 B2
(45) Date of Patent: Jan. 6, 2026

(54) EXCAVATION SYSTEM

(71) Applicant: KOBELCO CONSTRUCTION MACHINERY CO., LTD., Hiroshima (JP)

(72) Inventors: Daisuke Noda, Hiroshima (JP); Nobuhiro Fukuo, Hiroshima (JP); Masaki Akiyama, Hiroshima (JP); Takayuki Doi, Hiroshima (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 176 days.

(21) Appl. No.: 18/553,745

(22) PCT Filed: Mar. 8, 2022

(86) PCT No.: PCT/JP2022/009853

§ 371 (c)(1),
(2) Date: Oct. 3, 2023

(87) PCT Pub. No.: WO2022/215414

PCT Pub. Date: Oct. 13, 2022

(65) Prior Publication Data

US 2024/0183122 A1 Jun. 6, 2024

(30) Foreign Application Priority Data

Apr. 6, 2021 (JP) ..... 2021-064926

(51) Int. Cl.
*E02F 3/43* (2006.01)
*E02F 9/26* (2006.01)

(52) U.S. Cl.
CPC ..... *E02F 3/435* (2013.01); *E02F 9/262* (2013.01)

(58) Field of Classification Search
CPC ... E02F 3/437; E02F 3/42; E02F 3/434; E02F 3/404; E02F 3/43; E02F 9/265; A01G 17/02; A01C 5/06
See application file for complete search history.

(56) References Cited

U.S. PATENT DOCUMENTS 5,446,980 A 9/1995 Rocke
6,363,632 B1 4/2002 Stentz et al.
(Continued)

FOREIGN PATENT DOCUMENTS

CN 204335315 U * 5/2015 ..... A01C 5/06
CN 106677239 A * 5/2017 ..... E02F 3/42
(Continued)

OTHER PUBLICATIONS

International Search Report issued May 17, 2022 in PCT/JP2022/009853 filed on Mar. 8, 2022, 2 pages.
(Continued)

*Primary Examiner* — Yuri Kan
(74) *Attorney, Agent, or Firm* — Oblon, McClelland, Maier & Neustadt, L.L.P.

(57) ABSTRACT

A controller (30) of an excavation system controls a bucket (15*c*) to excavate an excavation object (O) along an excavation row (C). In a case where the bucket (15*c*) is located forward (X1) of a border (53) at completion of one excavation performed by the bucket (15*c*), the controller (30) causes the bucket (15*c*) to perform next excavation without changing the excavation row (C). In a case where the bucket (15*c*) is located on the border (53) or rearward (X2) of the border (53) at the completion of one excavation performed by the bucket (15*c*), the controller (30) changes the excavation rows (C) and causes the bucket (15*c*) to perform the next excavation.

2 Claims, 7 Drawing Sheets

(56) References Cited

U.S. PATENT DOCUMENTS

| | | | | |
|---|---|---|---|---|
| 9,091,044 | B2 * | 7/2015 | Choi | E02F 3/434 |
| 2012/0158234 | A1 * | 6/2012 | Choi | E02F 3/404 701/23 |
| 2012/0186112 | A1 * | 7/2012 | Tulibaski | E02F 3/962 37/195 |
| 2020/0199843 | A1 | 6/2020 | Ono | |
| 2022/0010521 | A1 | 1/2022 | Izumikawa | |
| 2022/0279699 | A1 * | 9/2022 | Mazzarolo | A01G 17/02 |
| 2023/0358015 | A1 * | 11/2023 | Miyazaki | E02F 9/265 |

FOREIGN PATENT DOCUMENTS

| | | | | | |
|---|---|---|---|---|---|
| CN | 112424427 | A | | 2/2021 | |
| JP | 55-55732 | A | | 4/1980 | |
| JP | H0626073 | A | * | 2/1994 | E02F 3/43 |
| JP | 10-212740 | A | | 8/1998 | |
| JP | 2001-123479 | A | | 5/2001 | |
| WO | WO 2019/049701 | A1 | | 3/2019 | |
| WO | WO 2020/196896 | A1 | | 10/2020 | |

OTHER PUBLICATIONS

Extended European Search Report issued Jul. 29, 2024 in European Patent Application No. 22784399.2, 7 pages.

Combined Chinese Office Action and Search Report issued Jul. 9, 2025 in Chinese Patent Application No. 202280019027.8 (with English translation of Office Action only), 12 pages.

* cited by examiner

EXCAVATION SYSTEM

TECHNICAL FIELD

The present invention relates to an excavation system that excavates an excavation object with a bucket.

BACKGROUND ART

For example, Patent Literature 1 and the like describe a technique of automatically operating a work machine and excavating an excavation object with a bucket. In the technique described in this literature, the excavation using the bucket is performed along an excavation row from front to rear as viewed from an upper slewing body. Then, when the excavation is completed, the upper slewing body slews, and excavation is performed along a new excavation row.

In a case where the excavation along a certain excavation row is performed only by one excavation operation, the excavation operation might be a useless operation such as continuing the excavation even though the excavation objects are fully inserted into the bucket. On the other hand, in a case where a plurality of excavation operations are performed on a certain excavation row, the plurality of excavation operations might be useless in a state where the excavation is performed even though the amount of excavation objects remaining on the excavation row is small. Therefore, it is desirable to improve the efficiency of the excavation operation.

CITATION LIST

Patent Literature

Patent Literature 1: JP 2001-123479 A

SUMMARY OF INVENTION

Therefore, an object of the present invention is to provide an excavation system capable of improving efficiency of an excavation operation in an automatic operation.

The excavation system includes a lower body (lower travelling body), an upper slewing body, an attachment, and a controller. The upper slewing body is slewably mounted on the lower travelling body. The attachment is mounted on the upper slewing body. The attachment includes a bucket for excavating an excavation object. The controller sets a border at a position spaced forward with respect to the upper slewing body. The controller controls the bucket to automatically excavate the excavation object in a direction of approaching the upper slewing body along an excavation row extending in a front-rear direction of the upper slewing body. In a case where the bucket is located forward of the border at completion of one excavation performed by the bucket, the controller causes the bucket to perform next excavation without changing the excavation row. In a case where the bucket is located on the border or rearward of the border at the completion of one excavation performed by the bucket, the controller changes the excavation row and causes the bucket to perform next excavation.

The above configuration can improve the efficiency of the excavation operation in the automatic operation.

DESCRIPTION OF EMBODIMENTS

An excavation system 1 will be described with reference to FIGS. 1 to 7.

Figure 1:
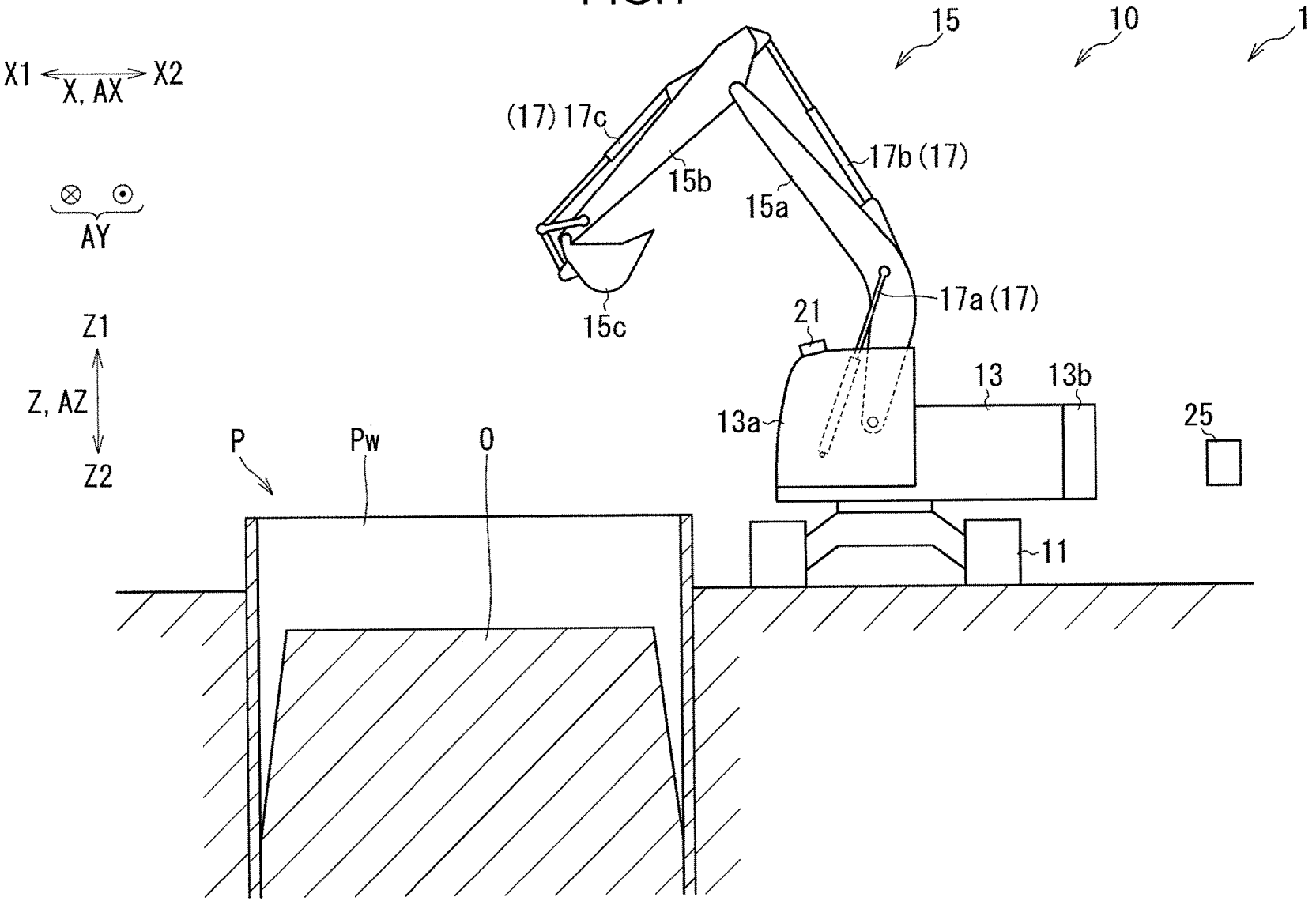
FIG. 1 is a diagram illustrating an excavation system 1, and is the diagram of when a work machine 10 and the like are viewed from a side.

As illustrated in FIG. 1, the excavation system 1 is a system for excavating an excavation object O. The excavation system 1 includes a work machine 10, an imaging device 21, an attitude detection unit 23 (see FIG. 4), an input device 25, and a controller 30 (see FIG. 4).

The work machine 10 is a machine that performs an excavation operation for excavating the excavation object O with a bucket 15*c*, and is an excavator. The work machine 10 is, for example, a construction machine that performs construction work. The excavation object O excavated by the work machine 10 may be dirt, crushed stone, or waste. The excavation object O may have, for example, a mountain shape (for example, a mountain of dirt), may be placed on the ground, or may be placed in a soil pit P (so as to be surrounded by a wall Pw). The work machine 10 includes a lower travelling body 11 (lower body), an upper slewing body 13, an attachment 15, and a drive unit 17 (see FIG. 4).

The lower travelling body 11 (lower body) causes the work machine 10 to travel. The lower travelling body 11 includes, for example, a crawler.

The upper slewing body 13 is slewably mounted on the lower travelling body 11. The attachment 15 is mounted on the upper slewing body 13. The upper slewing body 13 includes a cab 13*a* and a counterweight 13*b*. The cab 13*a* is a portion where an operator can operate the work machine 10. The work machine 10 may not be operated by the operator, and may be automatically operated by the controller 30 (see FIG. 4). The counterweight 13*b* is a weight for balancing the work machine 10 in a front-rear direction X.

(Definition of Direction Related to Work Machine 10)

Figure 2:
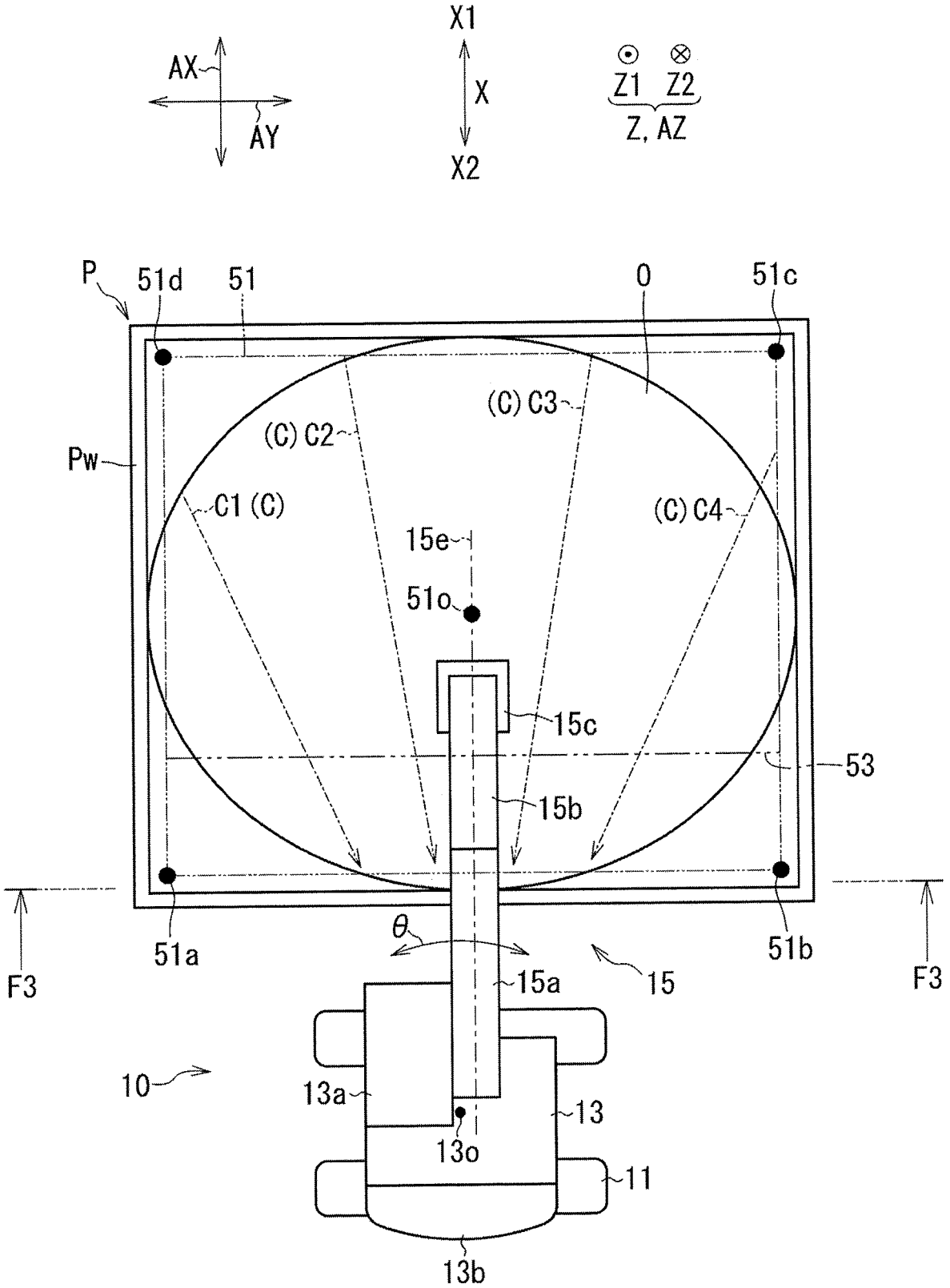
FIG. 2 is a diagram of the work machine 10 and the like illustrated in FIG. 1 as viewed from above.

A direction where a rotation axis (a slewing center 130 illustrated in FIG. 2) of slewing of the upper slewing body 13 with respect to the lower travelling body 11 extends is defined as an up-down direction Z. In the up-down direction Z, a direction from the lower travelling body 11 towards the upper slewing body 13 is defined as an upper side Z1, and the opposite direction is defined as a lower side Z2. As illustrated in FIG. 2, a direction where the attachment 15 extends when viewed from the up-down direction Z (a direction where the attachment 15 protrudes with respect to the upper slewing body 13) is defined as the front-rear direction X. In the front-rear direction X, a direction from the counterweight 13*b* towards an attachment portion where the attachment 15 is attached to the upper slewing body 13 is defined as "forward X1", and the opposite direction is defined as "rearward X2". That is, in the front-rear direction X, when the front side is viewed from the upper slewing body 13, a direction being away from the upper slewing body 13 is defined as forward X1, and the opposite direction is defined as rearward X2. A slewing direction of the upper slewing body 13 with respect to the lower travelling body 11 is defined as a slewing direction θ.

As illustrated in FIG. 1, the attachment 15 is attached to the upper slewing body 13 and performs an excavation operation. The attachment 15 includes a boom 15*a*, an arm 15*b*, and the bucket 15*c*. The boom 15*a* is mounted on the upper slewing body 13 so as to be able to be raised and lowered (rotatable in the up-down direction Z). The arm 15*b* is rotatably mounted to the boom 15*a*. The bucket 15*c* is a portion that excavates the excavation object O. The bucket 15*c* is located at a distal end of the attachment 15 and is rotatably mounted to the arm 15*b*. The bucket 15*c* has a shape capable of scooping the excavation object O.

The drive unit 17 drives the work machine 10. Specifically, the drive unit 17 includes a slewing motor (not illustrated) that slews the upper slewing body 13 with respect to the lower travelling body 11. The drive unit 17 includes a boom cylinder 17*a* that raises and lowers the boom 15*a* with respect to the upper slewing body 13, an arm cylinder 17*b* that rotates the arm 15*b* with respect to the boom 15*a*, and a bucket cylinder 17*c* that rotates the bucket 15*c* with respect to the arm 15*b*.

The imaging device 21 detects three-dimensional information about the position and shape of an imaging object. The "imaging object" includes at least one of the excavation object O and a peripheral object of the excavation object O. The imaging device 21 acquires an image (distance image) having distance information (depth information). The imaging device 21 may detect the three-dimensional information about the imaging object based on the distance image and the two-dimensional image. Only one imaging device 21 may be disposed, or a plurality of imaging devices 21 may be disposed. The imaging device 21 may be installed in the work machine 10 or may be disposed outside the work machine 10 (for example, at a workplace). The attitude detection unit 23, the input device 25, and the controller 30 illustrated in FIG. 4 may be also mounted on the work machine 10 or may be disposed outside the work machine 10.

The imaging device 21 may include a device that detects three-dimensional information using laser light. The imaging device 21 may include, for example, a Light Detection and Ranging or Laser Imaging Detection and Ranging (LiDAR), or a Time of Flight (TOF) sensor. The imaging device 21 may include a device (for example, a millimeter wave radar) that detects three-dimensional information using radio waves. The imaging device 21 may include a stereo camera. In a case where the imaging device 21 detects a three-dimensional position and shape of the imaging object based on three-dimensional information and two-dimensional information, the imaging device 21 may include a camera capable of detecting a two-dimensional image.

The attitude detection unit 23 detects the attitude of the work machine 10 illustrated in FIG. 1. The attitude detection unit 23 (see FIG. 4) detects the slewing angle of the upper slewing body 13 with respect to the lower travelling body 11. The attitude detection unit 23 detects a rotation angle (raising-and-lowering angle) of the boom 15*a* with respect to upper slewing body 13. The attitude detection unit 23 detects a rotation angle of the arm 15*b* with respect to boom 15*a*. The attitude detection unit 23 detects a rotation angle of the bucket 15*c* with respect to arm 15*b*. The attitude detection unit 23 may include an angle sensor attached to a rotation shaft of the boom 15*a* with respect to the upper slewing body 13, and the same applies to the arm 15*b* and the bucket 15*c*. The attitude detection unit 23 may include a tilt sensor that detects a tilt angle of the boom 15*a* with respect to the ground or the like, and the same applies to the arm 15*b* and the bucket 15*c*. The attitude detection unit 23 may include a stroke sensor that detects a stroke of a cylinder driving the boom 15*a* (the position of a cylinder rod with respect to a cylinder tube), and the same applies to the arm 15*b* and the bucket 15*c*. The attitude detection unit 23 may detect an attitude of the boom 15*a* based on a two-dimensional image or a distance image, and this applies also to the arm 15*b* and the bucket 15*c*. In this case, the two-dimensional image or the distance image may be captured by the imaging device 21.

The input device 25 is a device that allows an operator to input various types of information. The input device 25 may be, for example, a personal digital assistant (for example, a tablet, a smartphone, or the like) carried by an operator. The input device 25 may be disposed on the work machine 10 or may be disposed on a facility that remotely operates the work machine 10.

Figure 4:
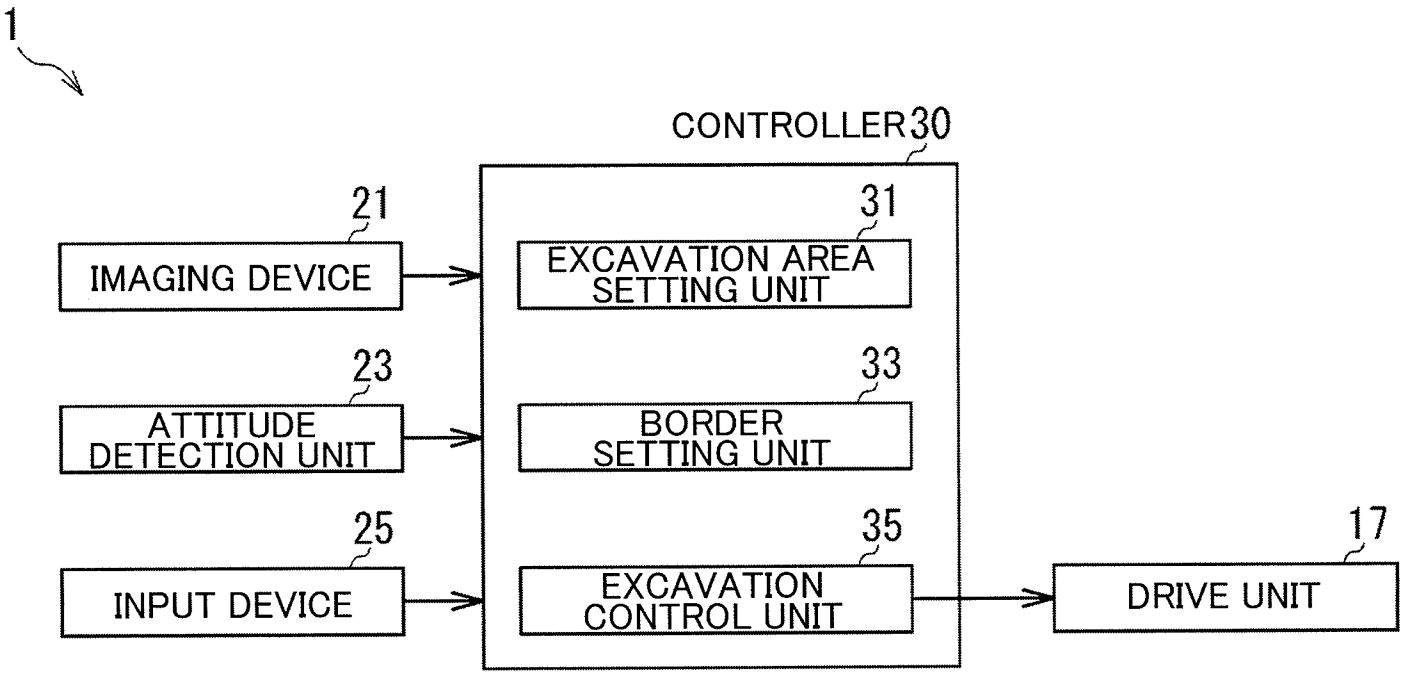
FIG. 4 is a block diagram of the excavation system 1 illustrated in FIG. 1.

The controller 30 (see FIG. 4) inputs and outputs signals, performs calculation (processing), stores information, and the like. For example, as illustrated in FIG. 4, the controller 30 receives signals from the imaging device 21, the attitude detection unit 23, and the input device 25. For example, the controller 30 outputs a signal for driving the drive unit 17. The controller 30 includes an excavation area setting unit 31, a border setting unit 33, and an excavation control unit 35.

The excavation area setting unit 31 sets an excavation area 51 (see FIG. 2) to be described later. The border setting unit 33 sets a border 53 (see FIG. 2) to be described later.

The excavation control unit 35 automatically operates the work machine 10 illustrated in FIG. 1. As will be described later, the excavation control unit 35 (see FIG. 4) controls the operation of the attachment 15 so that the operation of the bucket 15*c* is controlled and the excavation performed by the bucket 15*c* is controlled (automatic excavation is performed).

Operation

The excavation system 1 is configured to operate as follows.

Setting

Figure 3:
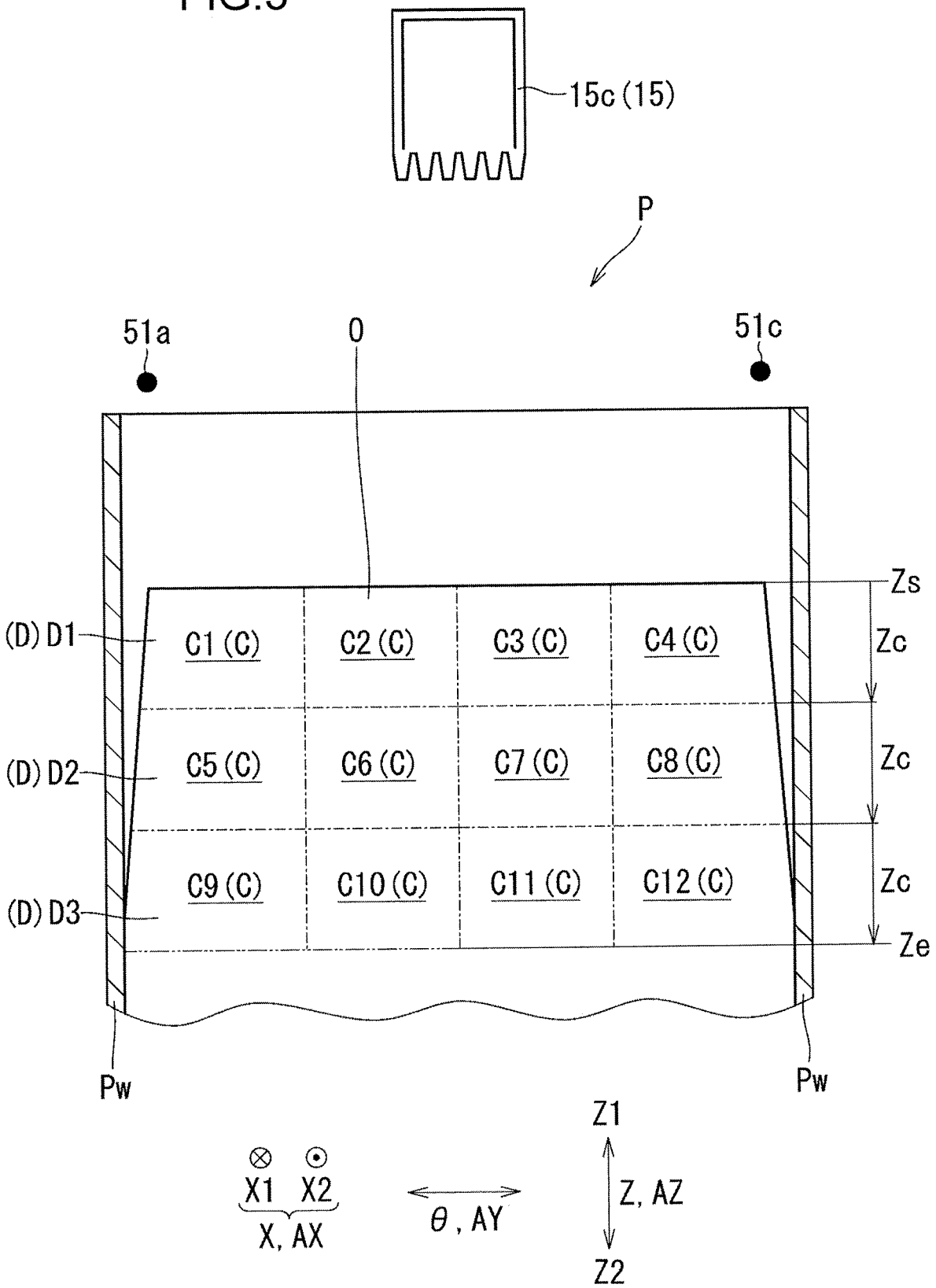
FIG. 3 is a view taken along a direction of line F3-F3 in FIG. 2.

Information necessary for excavation is set in the controller 30 (see FIG. 4). Hereinafter, the controller 30 will be described with reference to FIG. 4. Specifically, an excavation area 51 and the border 53 illustrated in FIG. 2, an excavation start height Zs, a one-cycle depth Zc, and a final depth Ze illustrated in FIG. 3 are set (see FIG. 5).

As illustrated in FIG. 2, the excavation area 51 is a range where the excavation object O is disposed. The excavation object O is disposed on at least a part of the excavation area 51. The controller 30 controls the bucket 15*c* to perform excavation inside the excavation area 51. The controller 30 causes the bucket 15*c* not to perform excavation outside the excavation area 51. When viewed from a vertical direction AZ, the shape of the excavation area 51 may be variously set. When viewed from the vertical direction AZ, the excavation area 51 may have a polygonal shape, for example, a quadrangle shape, a rectangular shape, a quadrangle shape other than the rectangular shape, or a shape (for example, a substantially polygonal shape) close thereto. When viewed from the vertical direction AZ, the excavation area 51 may have a circular shape, an oval shape, or a shape (for example, a substantially circular shape) close thereto. A certain direction related to the certain excavation area 51 and parallel to the horizontal plane is defined as an area front-rear direction AX. A direction orthogonal to each of the area front-rear direction AX and the vertical direction AZ is defined as an area lateral direction AY.

The excavation area 51 may be variously set. The excavation area 51 may be automatically set (calculated) by the excavation area setting unit 31 (see FIG. 4). Specifically, for example, the excavation area 51 may be automatically calculated based on the distance image of the excavation object O and a peripheral portion thereof, the distance image being acquired by the imaging device 21 (see FIG. 1). The excavation area 51 may be automatically calculated based on three-dimensional information about the workplace where the excavation object O is disposed (for example, three-dimensional information about the soil pit P). The excavation area 51 may be set by teaching (to be described later) using the attachment 15. The excavation area 51 may be set by values (for example, coordinates) input to the input device 25 (see FIG. 1). The excavation area 51 may be a fixed value set in advance in the excavation area setting unit 31 (see FIG. 4), or may be a value calculated and set in advance based on, for example, the information about the workplace (a terrain, a structure of the soil pit P, and the like).

A specific example of setting of the excavation area 51 in a case where the excavation area 51 is set by teaching is as follows. In a case where the excavation area 51 is set by teaching, a position (teaching point, e.g. position on the boundary) for determining the boundary between the inside and the outside of the excavation area 51 is designated by an operation performed on the attachment 15 by an operator. Here, a case where the excavation area 51 has a rectangular shape when viewed from the vertical direction AZ will be described. Positions of four corners of the excavation area 51 viewed from the vertical direction AZ are set as a point 51*a*, a point 51*b*, a point 51*c*, and a point 51*d*.

Figure 5:
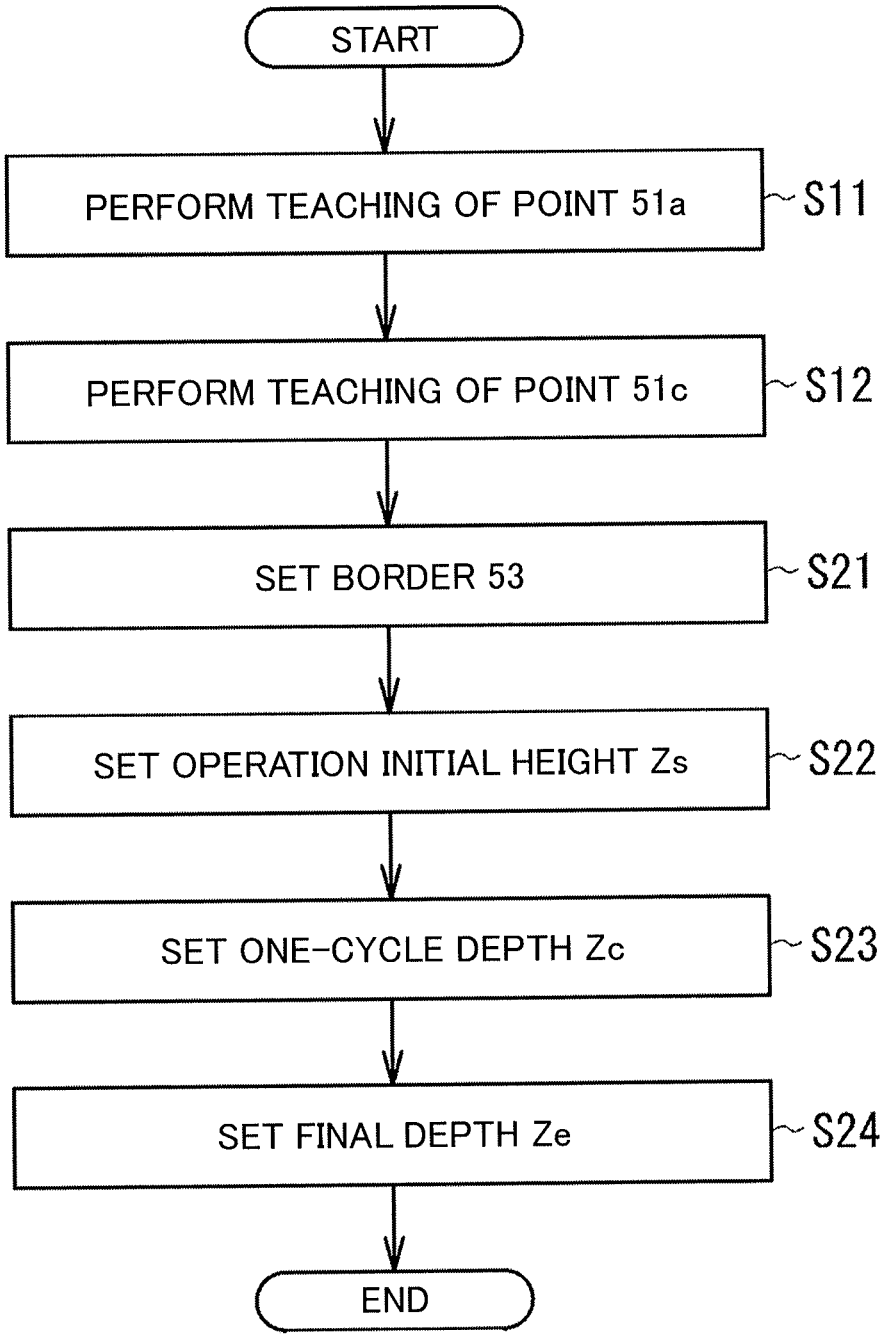
FIG. 5 is a flowchart illustrating processing for setting of an excavation area 51 illustrated in FIG. 2.

The operator of the work machine 10 operates the work machine 10 to perform teaching of the diagonal positions in the excavation area 51 as viewed from the vertical direction AZ, specifically, the points 51*a* and 51*c* (see steps S11 and S12 illustrated in FIG. 5). For example, the teaching of the point 51*a* is performed as follows. The operator operates the attachment 15 to move the distal end of the bucket 15*c* to a position to be set as the point 51*a*. Then, when the operator presses a determination button of the input device 25 (see FIG. 1), for example, the position of the distal end of the bucket 15*c* at this time is set as the point 51*a*. Specifically, coordinates (Xa) of the position of the point 51*a* in the front-rear direction X, coordinates (Za) of the position in the up-down direction Z, and a value (angle) (θa) of the slewing direction θ are set in the excavation area setting unit 31 (see FIG. 4). For example, as illustrated in FIG. 3, the position (Za) of the point 51*a* in the up-down direction Z may be set as a reference position of an excavation depth to be described later. Similarly to the point 51*a* illustrated in FIG. 2, the point 51*c* is set by teaching. Specifically, coordinates (Xc) of the point 51*c* in the front-rear direction X, coordinates (Zc) in the up-down direction Z, and a value (angle) (θc) in the slewing direction θ are set in the excavation area setting unit 31 (see FIG. 4).

The excavation area setting unit 31 (see FIG. 4) calculates the positions of the point 51*b* and the point 51*d* based on the positions of the point 51*a* and the point 51*c*. Specifically, for example, the central axis of the attachment 15 extending in the longitudinal direction of the attachment 15 as viewed from the vertical direction AZ is defined as an attachment central axis 15*e*. A center between the point 51*a* and the point 51*c* (for example, a midpoint of a straight line connecting the point 51*a* and the point 51*c*) is defined as an area center 510. At this time, as viewed from the vertical direction AZ, the front-rear direction X of the upper slewing body 13 is set as the area front-rear direction AX at a time when the attachment central axis 15*e* passes through the area center 510. When the area front-rear direction AX is determined, the area lateral direction AY is also determined. Note that the area front-rear direction AX and the area lateral direction AY may not be set based on the teaching result, and may be set based on, for example, the direction of the coordinate axis of the coordinate system of the workplace.

For example, the area front-rear direction AX is a direction where two sides (two sides facing each other: short sides in FIG. 2) of the excavation area 51 that is rectangular when viewed from the vertical direction AZ. The area lateral direction AY is a direction where the remaining two sides (long sides in FIG. 2) of the excavation area 51 rectangular when viewed from the vertical direction AZ extend. As a result, the positions of the point 51*b* and the point 51*d* are determined based on the positions of the point 51*a* and the point 51*c*. Note that the point 51*b* and the point 51*d* may be set by teaching. The excavation area setting unit 31 sets an area surrounded by the points 51*a*, 51*b*, 51*c*, and 51*d* as the excavation area 51.

Figure 7:
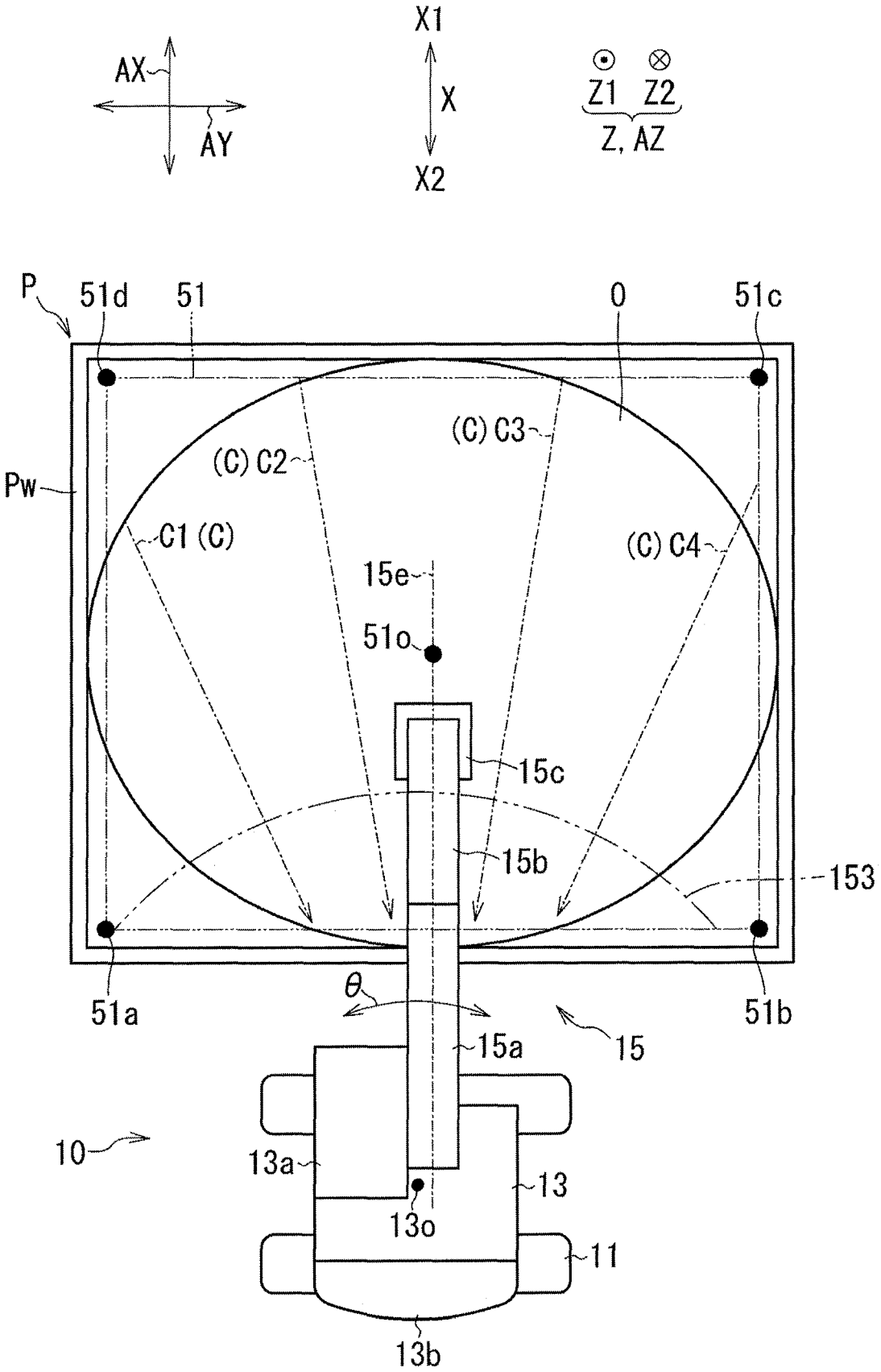
FIG. 7 is a diagram corresponding to FIG. 2 illustrating a modification of a border 53 illustrated in FIG. 2.

The border 53 is a boundary of whether to perform excavation with the excavation row C being changed. Details of the excavation will be described later. The border 53 is set at a position spaced apart from the upper slewing body 13. The border 53 is set at a position spaced apart forward X1 from the upper slewing body 13. For example, at least a part of the border 53 is set inside the excavation area 51. When viewed from the vertical direction AZ, the border 53 may be linear or curved (see a border 153 illustrated in FIG. 7). When viewed from the vertical direction AZ, the border 53 is set to extend in the area lateral direction AY, for example. As illustrated in FIG. 7, when viewed from the vertical direction AZ, the border 153 may have an arc shape, for example, a circumferential shape, more specifically, a circumferential shape centered on the slewing center 130. When viewed from the vertical direction AZ, the border 153 may have, for example, an arc shape (for example, a circumferential shape) protruding forward X1 as illustrated in FIG. 7.

The setting of the border 53 illustrated in FIG. 2 (see step S21 illustrated in FIG. 5) may be variously performed (the same applies to the border 153 illustrated in FIG. 7). The border 53 may be automatically calculated by the border setting unit 33 (see FIG. 4). Specifically, for example, the border 53 may be automatically calculated based on the information (position) about the excavation area 51 and the information (capacity, shape, size, and the like) about the bucket 15*c*. The border 53 may be set by teaching using the attachment 15. The border 53 may be set by a value (for example, a distance from a straight line passing through the point 51*a* and the point 51*c* or the like) input to the input device 25 (see FIG. 1). The border 53 may be a fixed value set in advance in the border setting unit 33 (see FIG. 4), or may be a value calculated and set in advance based on the information about the workplace (a terrain, a structure of the soil pit P, and the like).

The excavation start height Zs illustrated in FIG. 3 is the height of the bucket 15*c* (more specifically, the distal end of the bucket 15*c*) at the start of excavation of the excavation object O by the bucket 15*c*. The excavation start height Zs is preferably set as a height of the highest position (vertex) of the excavation object O or a position higher than the vertex. The setting of the excavation start height Zs (the setting of an operation initial height Zs in step S22 illustrated in FIG. 5) may be variously performed. The excavation start height Zs may be automatically calculated by the controller 30 (see FIG. 4). Specifically, for example, the excavation start height Zs may be automatically calculated based on the distance image captured by the imaging device 21 (see FIG. 1). The excavation start height Zs may be set by teaching using the attachment 15. The excavation start height Zs may be set by a value input to the input device 25 (see FIG. 1). The excavation start height Zs may be a height of a position to be a reference of excavation (for example, the point 51*a*) or may be determined based on the position to be a reference of excavation (the point 51*a*). The excavation start height Zs may be a preset fixed value.

The one-cycle depth Zc is an excavation depth (length in the up-down direction Z) at a time when the bucket 15*c* performs excavation for one cycle (one time). The setting of the one-cycle depth Zc (see step S23 illustrated in FIG. 5) may be variously performed. The one-cycle depth Zc may be automatically calculated by the controller 30 (see FIG. 4). Specifically, for example, the one-cycle depth Zc may be automatically calculated based on information about the bucket 15*c* (capacitance, shape, size, and the like). The one-cycle depth Zc may be set by a value input to the input device 25 (see FIG. 1), and the same applies to a final depth Ze to be described later. The one-cycle depth Zc may be a fixed value preset in the controller 30 (see FIG. 4), and the same applies to the final depth Ze.

The final depth Ze is a depth from a position to be a reference of excavation (for example, the point 51*a*) to a position where the excavation operation by the bucket 15*c* is completed. The setting of the final depth Ze (see step S24 illustrated in FIG. 5) may be variously performed. The controller 30 (see FIG. 4) is preferably configured to cause the bucket 15*c* to excavate the excavation object O to the final depth Ze and not to excavate a position deeper than the final depth Ze.

(Flow of Excavation)

The excavation system 1 (see FIG. 4) is configured to perform excavation as follows. The excavation control unit 35 (see FIG. 4) controls the bucket 15*c* to automatically excavate the excavation object O. The excavation control unit 35 controls the bucket 15*c* to excavate the excavation object O inside the excavation area 51 illustrated in FIG. 2. The excavation control unit 35 (see FIG. 4) controls the bucket 15*c* to excavate the excavation object O along at least one excavation row C. The excavation row C extends in the front-rear direction X. Note that in FIG. 2, only the central axes of the plurality of excavation rows C are illustrated.

The excavation row C is a trajectory (target trajectory) of the bucket 15*c* at the time when the bucket 15*c* is caused to perform excavation without slewing the upper slewing body 13 with respect to the lower travelling body 11. In the present embodiment, the controller 30 sets the plurality of excavation rows C in the excavation area 51. As illustrated in FIG. 3, the excavation rows C are set to corresponding each of a plurality of excavation stages D (three stages in FIG. 3). In the example illustrated in FIG. 3, the plurality of excavation stages D include a first excavation stage D1, a second excavation stage D2, and a third excavation stage D3 arranged in this order from the top. The height of the upper end of the first excavation stage D1 is, for example, identical to the excavation start height Zs or a position lower than the excavation start height Zs. The plurality of excavation rows C can be set in the first excavation stage D1. In the example illustrated in FIG. 3, the four excavation rows C (excavation rows C1, C2, C3, and C4) are set in the first excavation stage D1. As illustrated in FIG. 2, each interval (excavation row interval) between the central axes of the adjacent excavation rows C in the same excavation stage D may be a constant interval. Specifically, for example, each excavation row interval may be a constant interval in the slewing direction θ, or may be a constant interval in the area lateral direction AY. Each excavation row interval may not be constant. As illustrated in FIG. 3, similarly to the first excavation stage D1, four excavation rows C (excavation rows C5, C6, C7, and C8) are set in the second excavation stage D2. The height of the upper end of the second excavation stage D2 may be a height obtained by subtracting the one-cycle depth Zc from the excavation start height Zs. Four excavation rows C (excavation rows C9, C10, C11, and C12) are set in the third excavation stage D3. The height of a lower end of the third excavation stage D3 is the height of the final depth Ze. The height of an upper end of the third excavation stage D3 may be a height obtained by subtracting twice the one-cycle depth Zc from the excavation start height Zs. The number of the excavation rows C (for example, four in the example illustrated in FIG. 4) on one excavation stage D may be identical or different among the plurality of the excavation stages D.

The excavation control unit 35 (see FIG. 4) moves the bucket 15*c* illustrated in FIG. 2 rearward X2. The excavation control unit 35 controls the bucket 15*c* to excavate the excavation object O rearward X2. In each of the excavation rows C, one or a plurality of excavations is performed as described later.

The excavation control unit 35 (see FIG. 4) causes the bucket 15*c* to perform excavation while changing the excavation row C. For example, the excavation control unit 35 may change the slewing angle (the direction of the slewing direction θ) of the upper slewing body 13 to change the excavation row C where the bucket 15*c* performs excavation. For example, the excavation control unit 35 may change, by causing the lower travelling body 11 to travel, the excavation row C where the bucket 15*c* performs excavation.

As illustrated in FIG. 3, the excavation row C where excavation is to be performed next after excavation is completed in a certain excavation row C (for example, the excavation row C1) may be an excavation row C (any one of the excavation rows C2, C3, and C4) at the same excavation stage D including the excavation row C where the excavation is completed, or may be an excavation row C at the excavation stage D different from the excavation stage D including the excavation row C where the excavation is completed.

A specific example of a case where the excavation in a certain excavation row C is completed and the excavation row C is changed is as follows. First, excavation at the first excavation stage D1 is performed. For example, one or a plurality of excavations is performed in the excavation row C1 (described later). When the excavation on the excavation row C1 is completed, excavation is similarly performed also on the excavation rows C2, C3, and C4. Specifically, for example, as illustrated in FIG. 3, excavation is performed in the order of the excavation rows C1, C2, C3, and C4 from the left side portion (portion located on one side in the area lateral direction AY) to the right side portion (portion located on the opposite side to the one side in the area lateral direction AY) of the first excavation stage D1 when the excavation object O is viewed forward X1. For example, the excavation may be performed in the order of the excavation rows C4, C3, C2, and C1 from the right side portion to the left side portion of the first excavation stage D1 when the excavation object O is viewed forward X1. For example, after the excavation at the central portions (excavation rows C2, C3) in the area lateral direction AY of the first excavation stage D1 is performed, the excavation may be performed at the outer portion in the area lateral direction AY. When the excavation at the first excavation stage D1 is completed, the excavation at the second excavation stage D2 is performed. When the excavation at the second excavation stage D2 is completed, the excavation at the third excavation stage D3 is performed. Incidentally, the excavation may be completed on the excavation row C (for example, the excavation row C1) at only a part of the first excavation stage D1, and then, the excavation may be performed on the excavation row C (for example, the excavation row C5) at the second excavation stage D2 different from the first excavation stage D1. When the excavation is completed on all the excavation rows C at the first excavation stage D1 through the third excavation stage D3, the excavation operation is completed in the excavation area 51 (see FIG. 2).

(Excavation on One Excavation Row C)

The excavation on a certain excavation row C illustrated in FIG. 2 will be described. The bucket 15*c* starts excavation at the forward side portion of the excavation row C (for example, a portion located foremost X1 on the excavation row C) (see step S31 illustrated in FIG. 6). When the bucket 15*c* performs excavation towards the upper slewing body 13 and a predetermined condition is satisfied, one excavation by the bucket 15*c* is completed (see step S32 illustrated in FIG. 6). For example, the above-described "predetermined condition" may be a state where the amount (excavation amount) of the excavation object O excavated by the bucket 15*c* in one excavation exceeds a predetermined amount, or may be a state where it is assumed that the excavation amount exceeds the predetermined amount. Specifically, for example, the "predetermined condition" may be a state where the distance (excavation stroke) by which the bucket 15*c* has moved is a predetermined value or more. For example, the "predetermined condition" may be a state where the amount of the excavation object O in the bucket 15*c* imaged by the imaging device 21 (see FIG. 1) is a predetermined value or more. For example, even if the excavation is further performed in the state where the "predetermined condition" is satisfied, the amount of the excavation object O entering the bucket 15*c* does not increase or does not approximately increase. In addition, even if the excavation is further performed in the state where the "predetermined condition" is satisfied, the excavation object O might spill over from the bucket 15*c* when the bucket 15*c* is lifted. Therefore, the excavation operation further performed in the state where the "predetermined condition" is satisfied is useless. Thus, when the "predetermined condition" is satisfied, it is preferable that one excavation by the bucket 15*c* is ended.

(Determination of Border 53)

Figure 6:
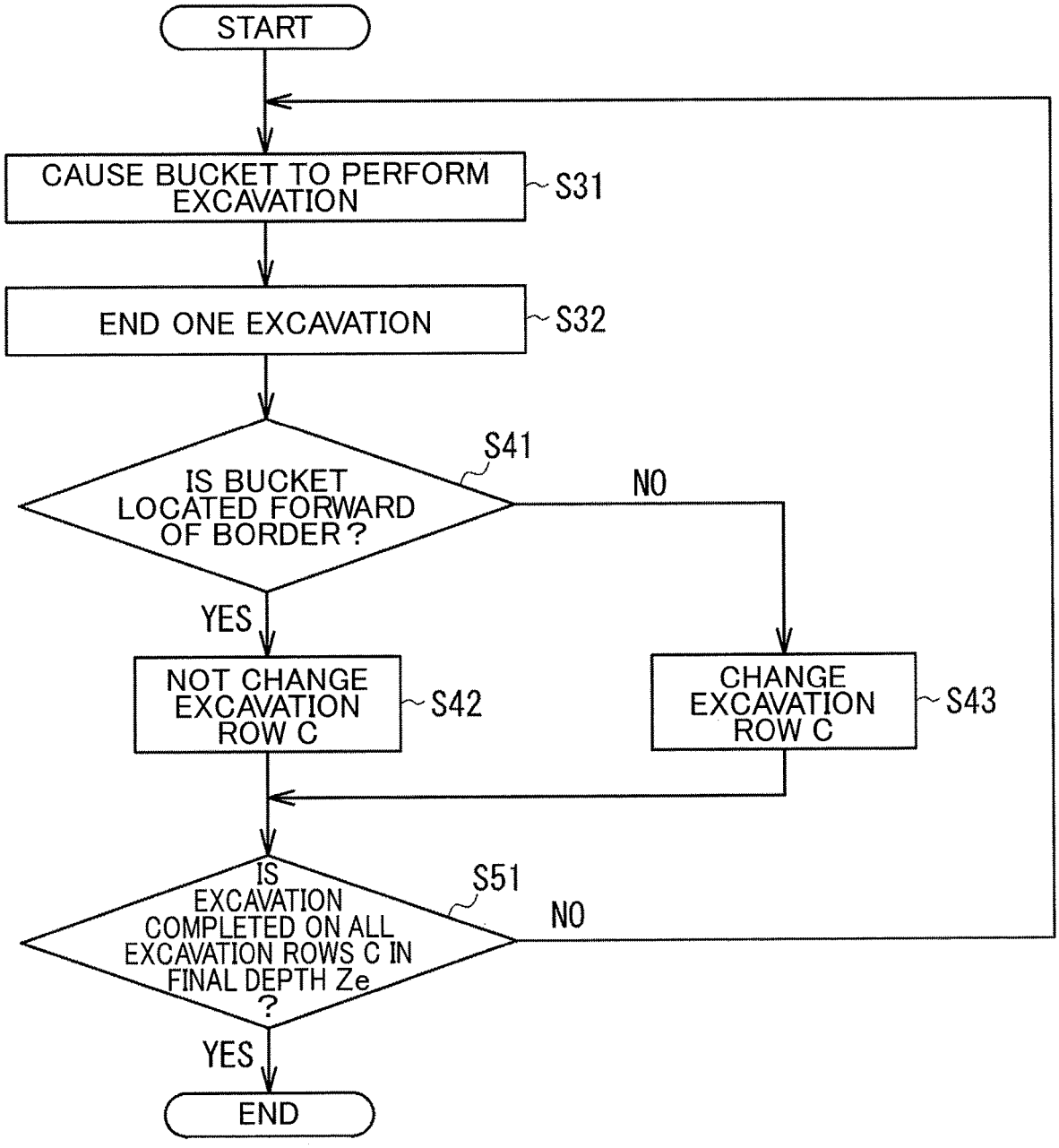
FIG. 6 is a flowchart illustrating processing of excavation along an excavation row C illustrated in FIG. 3.

The excavation control unit 35 (see FIG. 4) determines whether the bucket 15*c* is located forward X1 of the border 53 at completion of one-time excavation (hereinafter, simply referred to as "one excavation") by the bucket 15*c* (see step S41 illustrated in FIG. 6).

A case where the bucket 15*c* is located forward X1 of the border 53 at the completion of one excavation (case of YES in step S41) will be described. In this case, a large amount of the excavation object O remains in the rear portion of the excavation row C (the portion being rearward X2 in the excavation row C). Therefore, in this case, the excavation control unit 35 (see FIG. 4) causes the bucket 15*c* to perform next excavation on the same excavation row C without changing the excavation row C (see step S42 illustrated in FIG. 6). For example, in a case where one excavation is completed on the excavation row C1, the excavation control unit 35 causes the bucket 15*c* to perform excavation on the excavation row C1 again next time. In this case, the excavation control unit 35 causes the bucket 15*c* to start the next excavation from the position of the bucket 15*c* at the completion of one excavation or near the position.

A case where the bucket 15*c* is located on the position of the border 53 or located rearward X2 of the border 53 at the completion of one excavation (a case of NO in step S41 illustrated in FIG. 6) will be described. In this case, it is assumed that the amount of the excavation object O entering the bucket 15*c* is less even if the excavation is further performed on the excavation row C1. More specifically, on the excavation row C1, a certain amount of the excavation object O may remain at a portion rearward X2 with respect to the position of the bucket 15*c* at the completion of one excavation. However, the remaining amount of the excavation object O is so small that the bucket 15*c* cannot be sufficiently filled (the position of the border 53 is set so that the bucket 15*c* is in such a state). Therefore, even if the bucket 15*c* is caused to further perform excavation on the same excavation row C1, this excavation becomes a useless operation. Therefore, in this case, the excavation control unit 35 (see FIG. 4) changes the excavation row C and causes the bucket 15*c* to perform next excavation (see step S43 illustrated in FIG. 6). That is, the excavation control unit 35 causes the bucket 15*c* to perform excavation on another excavation row C without performing excavation of the excavation object O remaining on the excavation row C1. Specifically, for example, the excavation control unit 35 changes the excavation row C from the excavation row C1 to the excavation row C2, and causes the bucket 15*c* to perform the next excavation.

(Shape of Border 153)

As described above and illustrated in FIG. 7, when the border 153 is viewed from the vertical direction AZ, the border 153 may be set to have an arc shape protruding forward X1 with respect to the upper slewing body 13. The reason why the border 153 is set in this manner is as follows. In the example illustrated in FIG. 2, a boundary being rearward X2 in the excavation area 51 extends in the area lateral direction AY (for example, linear shape) when viewed from the vertical direction AZ, and the border 53 has a linear shape extending in the area lateral direction AY. In this example, the length of the excavation row C rearward X2 of the border 53 varies in accordance with the excavation row C (in accordance with the position in the slewing direction θ or the position in the area lateral direction AY). Specifically, in the example illustrated in FIG. 2, the length of the excavation row C rearward X2 of the border 53 is longer on the outer side (side close to the point 51*a* and side close to the point 51*b*) in the area lateral direction AY than at the central portion in the area lateral direction AY. Then, as described above, in a case where one excavation is completed rearward X2 of the border 53, the excavation object O remains on this excavation row C. Therefore, it is assumed that a larger amount of the excavation object O remains at the outer portion in the area lateral direction AY than at the central portion in the area lateral direction AY.

On the other hand, in the example illustrated in FIG. 7, the border 153 is set to have an arc shape protruding forward X1 when viewed from the vertical direction AZ. Therefore, when the excavation row C at the central portion in the area lateral direction AY is compared with the excavation row C at the outside portion in the area lateral direction AY (outside portion in the slewing direction θ), the length of the excavation row C rearward X2 of the border 153 is constant or approximately constant. Therefore, in the plurality of excavation rows C at different positions in the area lateral direction AY (the slewing direction θ), the amount of the excavation object O remaining on the respective excavation rows C can be made constant or approximately constant. Therefore, the excavation object O can be excavated uniformly at the rear portion of the excavation object O (the portion of the excavation object O located rearward X2). For example, the excavation object O can be excavated uniformly at the portion located rearward X2 in the excavation area 51. Therefore, the efficiency of the excavation operation can be improved.

Effects of First Invention

As illustrated in FIG. 1, the excavation system 1 includes the lower travelling body 11 (lower body), the upper slewing body 13, the attachment 15, and the border setting unit 33 and the excavation control unit 35 illustrated in FIG. 4. The upper slewing body 13 installed in FIG. 1 is slewably mounted on the lower travelling body 11. The attachment 15 is mounted on the upper slewing body 13. The attachment 15 includes the bucket 15*c* for excavating the excavation object O. As illustrated in FIG. 2, the border setting unit 33 (see FIG. 4) sets the border 53 at a position spaced apart from the upper slewing body 13. The excavation control unit 35 (see FIG. 4) controls the bucket 15*c* to automatically excavate the excavation object O in the direction (rearward X2) of approaching the upper slewing body 13 along the excavation row C extending in the front-rear direction X of the upper slewing body 13.

[Configuration 1-1] In a case where the bucket 15*c* is located forward X1 of the border 53 at the completion of one excavation by the bucket 15*c*, the excavation control unit 35 (see FIG. 4) causes the bucket 15*c* to perform next excavation without changing the excavation row C. In other words, in a case where the bucket 15*c* is located ahead (namely, forward X1) of the border 53 when viewed from the upper slewing body 13 at the completion of one excavation by the bucket 15*c*, the excavation control unit 35 causes the bucket 15*c* to perform next excavation without changing the excavation row C.

[Configuration 1-2] In a case where the bucket 15*c* is located on the position of the border 53 or rearward X2 of the border 53 at the completion of one excavation by the bucket 15*c*, the excavation control unit 35 (see FIG. 4) changes the excavation row C and causes the bucket 15*c* to perform next excavation. In other words, in a case where the bucket 15*c* is located on the position of the border 53 or closer side (namely, rearward X2) than the border 53 when viewed from the upper slewing body 13 at the completion of one excavation by the bucket 15*c*, the excavation control unit 35 changes the excavation row C and causes the bucket 15*c* to perform the next excavation.

The following effects can be obtained by [Configuration 1-1] described above. A case where the bucket 15*c* is located forward X1 of the border 53 at the completion of one excavation by the bucket 15*c* in a certain excavation row C (case of a) will be described. In this case, it is assumed that a larger amount of the excavation object O remains on a rear portion in the excavation row C (the portion being rearward X2 in the excavation row C). Therefore, in the above [Configuration 1-1], the bucket 15*c* is caused to perform excavation in the same excavation row C where the previous excavation by the bucket 15*c* is completed (for example, the excavation row C1) without changing the excavation row C (for example, the excavation row C1). Therefore, the excavation object O can be excavated at the rear portion in the excavation row C (the portion located rearward X2 in the excavation row C).

The following effects can be obtained by [Configuration 1-2] described above. A case where the bucket 15*c* is located on the border 53 or rearward X2 of the border 53 at the completion of one excavation by the bucket 15*c* in a certain excavation row C will be described. In this case, the amount of excavation object O remaining on the rear portion (portion located rearward X2) in this excavation row C (for example, the excavation row C1) is smaller than in the above case α. Therefore, even if the excavation is further performed in this excavation row C (for example, the excavation row C1), the amount of the excavation object O that can be excavated is small, and the excavation operation is inefficient. Therefore, in [Configuration 1-2], the excavation control unit 35 changes the excavation row C (for example, changes the excavation row C from the excavation row C1 to the excavation row C2), and causes the bucket 15*c* to perform next excavation on the changed excavation row C (in this example, the excavation row C2). Therefore, according to [Configuration 1-1] and [Configuration 1-2] described above, the excavation operation in the automatic operation can be made more efficient than in a case where the border 53 is not set.

Effects of Second Invention

[Configuration 2] As illustrated in FIG. 7, when viewed from the vertical direction AZ, the border 153 is set to have an arc shape protruding forward X1 with respect to the upper slewing body 13. In other words, when viewed from the vertical direction AZ, the border 153 is set to have an arc shape protruding ahead when viewed from the upper slewing body 13 (namely, forward X1).

According to [Configuration 2] described above, the length (excavation stroke) of the excavation row C rearward X2 of the border 153 can be made constant or approximately constant even if the slewing angle (position in the slewing direction θ) of the upper slewing body 13 changes. Therefore, even if the slewing angle of the upper slewing body 13 changes, the amount of the excavation object O remaining on the portion located rearward X2 of the border 153 can be made constant or approximately constant. Therefore, the excavation object O can be excavated uniformly at the rear portion of the excavation object O (the portion located rearward X2). Therefore, the efficiency of the excavation operation can be further improved.

MODIFICATIONS

The above embodiment may be variously modified. For example, the disposition and shape of each component of the embodiment may be changed. For example, the connection of each component illustrated in FIG. 4 may be changed. For example, the order of the steps in the flowcharts illustrated in FIGS. 5 and 6 may be changed, and some of the steps need not be performed. For example, the various setting values (for example, the one-cycle depth Zc), the setting range (for example, the excavation area 51), the border 53, and the like may be constant, may be changed by a manual operation, or may be automatically changed in accordance with any condition. For example, the number of components may be changed, and some of the components need not be provided.

For example, a plurality of components and parts different from each other may be described as one component and part. For example, what has been described as one component and part may be provided separately in a plurality of different components and parts. Specifically, the components (the excavation area setting unit 31, the border setting unit 33, and the excavation control unit 35) of the controller 30 illustrated in FIG. 4 may be collectively provided in one controller 30 or may be provided in separate controllers.

The invention claimed is:

1. An excavation system comprising:

a lower travelling body;

an upper slewing body slewably mounted on the lower travelling body;

an attachment attached to the upper slewing body, the attachment having a bucket that excavates an excavation object; and a controller, wherein the controller sets target trajectories of the bucket, the target trajectories including a first excavation row and a second excavation row each extending in a front-rear direction of the upper slewing body, the first excavation row and the second excavation row being located with an interval from each other in a slewing direction of the upper slewing body with respect to the lower travelling body, the controller sets a border at a position spaced forward with respect to the upper slewing body, the border being a boundary for determining whether to change the target trajectory from the first excavation row to the second excavation row, the controller causes the bucket to perform one excavation of excavating the excavation object along the first excavation row in a direction of approaching the upper slewing body, the controller causes the bucket to perform next excavation of excavating the excavation object along the first excavation row without changing the target trajectory in a case where the bucket is located forward of the border at completion of the one excavation by the bucket, and the controller changes the target trajectory from the first excavation row to the second excavation row and causes the bucket to perform the next excavation along the second excavation row in a case where the bucket is located on the border or rearward of the border at the completion of the one excavation by the bucket.

2. The excavation system according to claim 1, wherein the border is set to an arc shape protruding forward with respect to the upper slewing body when being viewed from a vertical direction.

* * * * *